US011298584B2

(12) United States Patent
Wamser et al.

(10) Patent No.: US 11,298,584 B2
(45) Date of Patent: Apr. 12, 2022

(54) TRAINING APPARATUS

(71) Applicant: BIOROWER HANDELSAGENTUR GMBH, Vienna (AT)

(72) Inventors: Adolf Wamser, Vienna (AT); Dusan Adamovic, Vienna (AT); Aram Lemmerer, Vienna (AT)

(73) Assignee: BIOROWER Handelsagentur GmbH, Vienna (AT)

( * ) Notice: Subject to any disclaimer, the term of this patent is extended or adjusted under 35 U.S.C. 154(b) by 132 days.

(21) Appl. No.: 16/621,980

(22) PCT Filed: Jun. 12, 2018

(86) PCT No.: PCT/AT2018/060121
§ 371 (c)(1),
(2) Date: Dec. 12, 2019

(87) PCT Pub. No.: WO2018/227224
PCT Pub. Date: Dec. 20, 2018

(65) Prior Publication Data

US 2021/0283460 A1 Sep. 16, 2021

(30) Foreign Application Priority Data

Jun. 12, 2017 (AT) ..... A50488/2017

(51) Int. Cl.
*A63B 22/00* (2006.01)
*A63B 21/00* (2006.01)
(Continued)

(52) U.S. Cl.
CPC ..... *A63B 22/0076* (2013.01); *A63B 21/0051* (2013.01); *A63B 21/00069* (2013.01);
(Continued)

(58) Field of Classification Search
CPC ..... A63B 22/0076; A63B 21/0051; A63B 22/0087; A63B 21/15; A63B 21/00069; A63B 21/225; A63B 2022/0082
See application file for complete search history.

(56) References Cited

U.S. PATENT DOCUMENTS 3,266,801 A * 8/1966 Johnson ..... A63B 22/0076 482/73
3,528,653 A 9/1970 Stuckenschneider et al.
(Continued)

FOREIGN PATENT DOCUMENTS

CA 2811911 A1 9/2013
CN 2868354 Y 2/2007
(Continued)

*Primary Examiner* — Andrew S Lo
*Assistant Examiner* — Andrew M Kobylarz
(74) *Attorney, Agent, or Firm* — Laurence A. Greenberg; Werner H. Stemer; Ralph E. Locher

(57) ABSTRACT

A training apparatus for the simulation of rowing training includes a rolling seat to be moved linearly back and forth on a guide on a frame. Two handles which can be rotated independently of one another are mounted on an oarlock shaft. The oarlock shafts are connected to a drive mechanism in a force-flow connection. Upon introduction of force to the handles, power is output to a braking device via a drive mechanism, which has a freewheel between the oarlock shafts and the braking device. Upon actuation of the handles in a first direction about the axis of the respective rowlock shafts, power is transmitted to the braking device, and, upon actuation of the handles in the opposite direction the handles return without power being transmitted to the braking device.

18 Claims, 7 Drawing Sheets

(51) Int. Cl.
*A63B 21/005* (2006.01)
*A63B 21/22* (2006.01)

(52) U.S. Cl.
CPC ..... *A63B 21/15* (2013.01); *A63B 21/225* (2013.01); *A63B 22/0087* (2013.01); *A63B 2022/0082* (2013.01)

(56) References Cited

U.S. PATENT DOCUMENTS

| | | | | |
|---|---|---|---|---|
| 4,984,986 | A | 1/1991 | Vohnout | |
| 5,092,581 | A | 3/1992 | Koz | |
| 7,833,136 | B2 * | 11/2010 | Bell | A63B 21/154 482/72 |
| 7,862,484 | B1 * | 1/2011 | Coffey | A63B 21/157 482/72 |
| 8,192,332 | B2 | 6/2012 | Baker et al. | |
| 2007/0197347 | A1 | 8/2007 | Roach | |
| 2008/0280736 | A1 * | 11/2008 | D'Eredita | A63B 21/154 482/72 |
| 2010/0240494 | A1 * | 9/2010 | Medina | A63B 22/0076 482/5 |

FOREIGN PATENT DOCUMENTS

| | | | |
|---|---|---|---|
| DE | 1703771 | A1 | 3/1972 |
| WO | 9722389 | A1 | 6/1997 |

* cited by examiner

TRAINING APPARATUS

BACKGROUND OF THE INVENTION

Field of the Invention

The invention relates to a training apparatus for the simulation of rowing training, including a guide which is arranged on a frame, a sliding seat which is movable back and forth in a linear manner along the guide, a footrest which is arranged in the region of an end of the guide, two handles which are rotatable independently of one another and are each rotatably mounted on an oarlock shaft, wherein the oarlock shafts are each arranged on a side of the guide, in particular normal to the direction of movement of the guide and/or to the standing surface of the frame, at a distance from the guide and a drive mechanism to which each oarlock shaft is connected in a force-transmitting manner. The drive mechanism comprises a gearing and a braking device and the drive mechanism is realized in such a manner that when force is transmitted to the handles, power can be output to the braking device via the drive mechanism.

A plurality of training apparatuses for the simulation of rowing training are disclosed in the prior art, each of which comprises a sliding seat which is movable to and fro or back and forth along a guide. Such training apparatuses, also named rowing machines or rowing ergometers, further comprise a so-called footrest on which the feet of the user are able to be placed and which is mostly arranged at one end of the guide of the sliding seat. A handle, which has two gripping surfaces and is arranged on a cable, is mostly used for transmitting arm power to the rowing ergometer, the cable being pulled out of the rowing ergometer when the traction forces are transmitted to the handle, and a braking mechanism, for example a magnetic brake or a turbine wheel which rotates in water, thus being actuated and the power of the rower thus being discharged. Such a rowing machine is disclosed, for example, in U.S. Pat. No. 8,192,332 A1 [2010; BAKER DAVID GARDNER; et. al].

A disadvantage of the rowing ergometer disclosed in the prior art is that the resistance of the braking devices in most cases is not able to simulate the authentic rowing on water and above all the restricted movement of the handles, which are mostly connected together for the left and right hand, can only simulate the independent movement of the oars on a rowing boat in an inadequate manner. A further disadvantage of the rowing ergometer disclosed in the prior art is that an authentic rowing movement is not able to be carried out, as a result of which the user always only achieves an inadequate training effect on an ergometer and the stroke sequence on a rowing boat is not learnt correctly or is distorted.

SUMMARY OF THE INVENTION

It is the object of the present invention, consequently, to provide a rowing machine or rowing ergometer which, on the one hand, allows the force of the two arms or hands of the user to be transmitted independently to the braking device and additionally reproduces the resistance of oars in the water in as authentic a manner as possible.

Said object is achieved by the characteristic features as claimed. In this case, it is provided that the drive mechanism comprises at least one freewheel, wherein the freewheel is arranged in such a manner between the oarlock shafts and the braking device that the handles are pivotable independently of one another about the respective oarlock shaft and, when the handles are actuated in a first direction about the axis of the respective oarlock shafts, power can be discharged to the braking device and when the handles are actuated in a second direction, which is opposite to the first direction, about the axis of the respective oarlock shafts, the handles are returnable without power being fed to or discharged from the braking device.

As a result of the handles which are movable independently from one another, the sequence of movement of a rower is simulated realistically as the rower is able to move as in a rowing boat. Additionally, as a result of the special force transmission system of the drive mechanism, the resistance of the water to the handles is simulated realistically and the hydrodynamic resistance of the oars in the water is imitated in a particularly advantageous manner. Additionally, as a result of the independently rotatable handles, the coordination between the left and right hand of the rower is better trained, as a result of which an enhanced training effect and greater improvements in performance in a rowing boat are achieved.

Particularly advantageous embodiments of the training apparatus are defined in more detail by the features of the dependent claims:

An advantageous embodiment is provided by a lever, which is pivotable with the handles about the axis of the respective oarlock shaft, being arranged on each of the oarlock shafts, in particular on each end of the oarlock shaft opposite the handles, wherein a pulling element, in particular a pull rod, by way of which the rotational movement of the handles is transmittable to the drive mechanism, is arranged on each lever. As a result of the force transmission from the handles via the oarlock shaft to the drive mechanism by means of a lever and the pulling element, the returning of the handles independently of one another is advantageously improved, no further elements being necessary for the returning of the pulling elements in contrast to the cable pull elements disclosed in the prior art.

An advantageous transmission of the forces or of the power from the oarlock shafts and the pulling elements into the drive mechanism is achieved by a drawbar being arranged on each end of the respective pulling element opposite the oarlock shaft, wherein power is transmittable from the handles to the drive mechanism by means of the drawbar.

A particularly compact design of the training apparatus is achieved by the drawbars being arranged in such a manner in two planes arranged one above the other in parallel at a distance that the pivoting movements of the drawbars intersect one another in a projecting plane without the drawbars touching one another. As a result of the intersection of the pivoting movements of the drawbars in different planes, the distances between drawbars in the lateral direction or in the direction of the oarlock shafts can be reduced and a space-saving and particularly compact realization of the training apparatus is thus achieved.

An advantageous realization of the training apparatus is provided by the drive mechanism comprising at least one force-transmitting element, in particular a chain drive or a belt drive or a pair of gear wheels, wherein the force-transmitting element is arranged between one of the oarlock shafts and the braking device in such a manner that the various directions of rotation of the oarlock shafts are deflectable into one common direction of rotation. The power of the handles, which are rotatable independently of one another, can be transmitted simply to one single braking device. As, in the case of the rowing movement, the two handles are pulled in the direction of the chest of the user, a rotational movement, which is in each case in the opposite direction to that of the other oarlock shaft, is generated at the two oarlock shafts. Said rotational movement can be deflected into one common direction of rotation as a result of the realization of the drive mechanism with a force-transmitting element, as a result of which the power of the individual handles can be added or combined or totaled and then delivered together to the braking device, the independent rotatability of the handles, however, remaining unchanged.

In order to be able to forward the force or power of the user to the drive mechanism in an advantageous and direct manner with little play, it can be provided that the drive mechanism comprises a first chain drive or a first belt drive or a first pair of gear wheels, by way of which the rotational movement of the first oarlock shaft is transmittable to a first freewheel, wherein the rotational movement of the second oarlock shaft is transmittable via a second chain drive or a second belt drive or a second pair of gear wheels to a second freewheel, wherein the first freewheel includes a first intermediate shaft and the second freewheel includes a second intermediate shaft, and wherein the rotational movement of the second intermediate shaft is transmittable to the first intermediate shaft by means of an intermediate chain drive or an intermediate pair of gear wheels or an intermediate belt drive so that the power or force which is transmitted to the handles can be added to the first intermediate shaft, and wherein the added power is deliverable to the braking device via the first intermediate shaft, in particular via a further chain drive or a further belt drive or a further pair of gear wheels.

An even more authentic rowing feeling is made possible by the handles being realized in the form of elongated cylinders, wherein the handles are preferably rotatable in their axes and wherein the handles comprise a stop by way of which the rotation in the cylinder axes of the handles can be delimited. The rotation of the handles in their axes makes possible a further, more authentic sequence of movements of the rower or of the user of the training apparatus as the tilting or rotating-in of the hand joints and oars or handles can be effected in particular in the end phase of the rowing stroke.

Direct feedback can be given to the user in a simple manner by a force measuring device, by way of which the transmission of force to the drive mechanism by means of the handles is measurable, being integrated in the handles, wherein the force measuring device includes, in particular, a number of strain gauges by way of which the bending deformation of the handles is measurable.

A movement up and down of the handles similar to an oar can be provided simply by the handles being pivotably mounted in an axis normal to the axis of the oarlock shaft, in particular at an end of the respective oarlock shaft.

An advantageous realization of the training apparatus is provided by the braking device including a fan wheel, a magnetic or eddy current brake or as an element which generates an electric current.

Where the braking device is realized with a fan wheel, the hydrodynamic resistance of the water can be reproduced simply by an aerodynamic resistance, which leaves the user with an authentic rowing feeling. Realizing said braking device by means of a magnetic or eddy current brake or as an element which generates an electric current allows the resistance or the braking performance to be designed variably, as a result of which different training scenarios are able to be reproduced. Electric current can also be generated by the power of the rower by means of a current-generating element, which, in turn, can be utilized for operating the electronic unit or other electrical devices.

It can advantageously be provided that two outriggers are arranged on the frame, wherein the oarlock shafts are each mounted in one of the outriggers.

In order to be able to simulate the characteristics of a rowing boat in the water in an even better manner, it can be provided that the force measuring device is realized in such a manner that the force applied to the handles and/or position of the handles, in particular about their axes, is supplied to an electronic evaluation unit and that the resistance of the braking device is adjustable in dependence on the force applied to the handles and/or the position of the handles, in particular about their axes.

A preferred embodiment is provided by the oarlock shafts each comprising on an end an oarlock, on each of which the handles are mounted.

Further advantages and designs of the invention are produced from the description and the accompanying drawings.

The invention is shown schematically in the drawings below by way of particularly advantageous exemplary embodiments which are not, however, to be understood as limiting and is described as an example with reference to the drawings:

DESCRIPTION OF THE INVENTION

Figure 1:
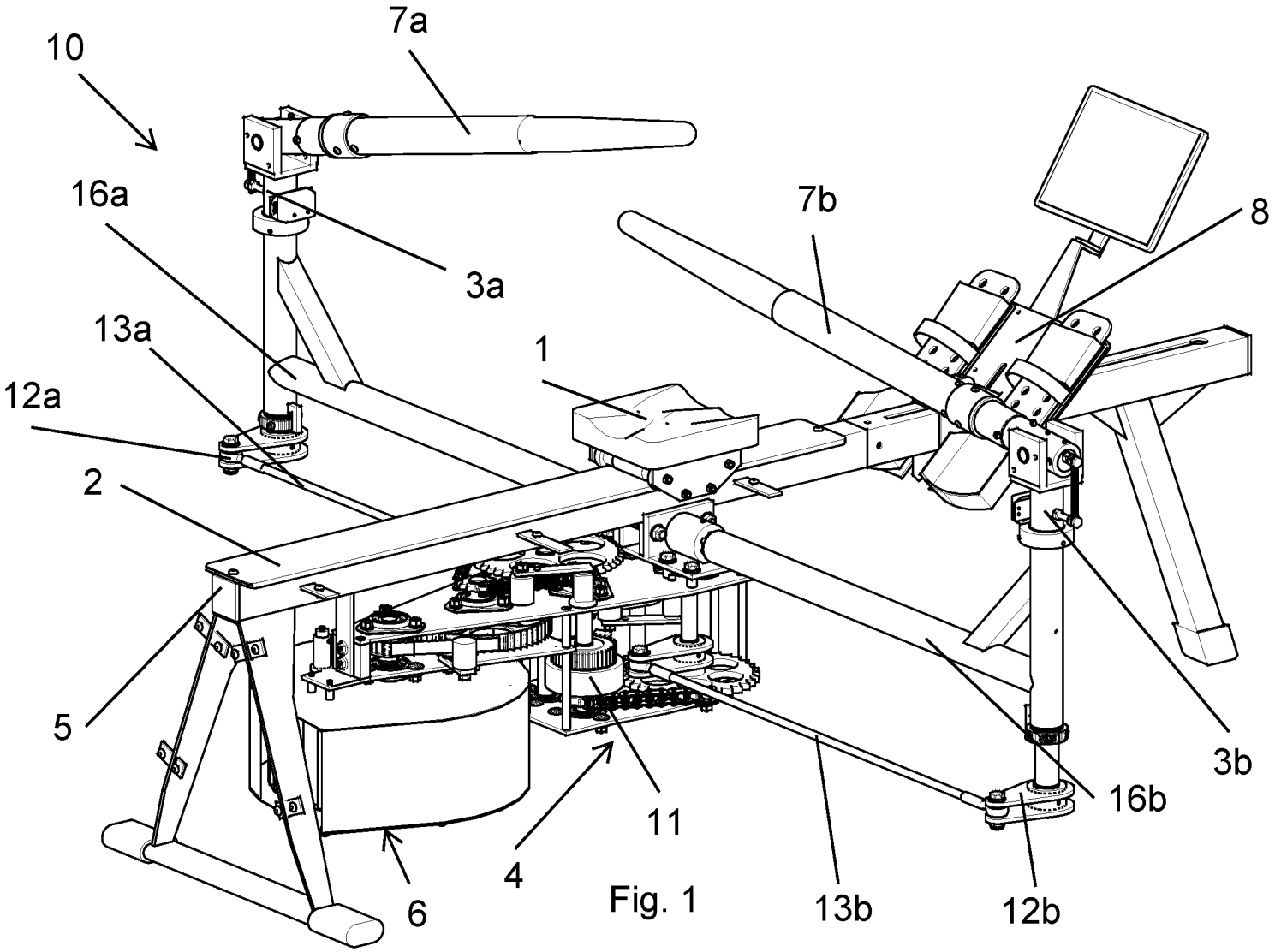
FIG. 1 shows an isometric view of an embodiment of a training apparatus according to the invention.

FIG. 1 shows an isometric view of a training apparatus 10 according to the invention for the simulation of rowing training. The training apparatus 10 includes two handles 7*a*, 7*b* which are each rotatably mounted in two oarlock shafts 3*a*, 3*b*. The handles 7*a*, 7*b* are each pivotably mounted on an end with the respective oarlock shaft 3*a*, 3*b* in addition in an axis normal to the axis of the oarlock shaft 3*a*, 3*b*. The training apparatus 10 additionally comprises a frame 5, on which a guide 2 is arranged. A sliding seat 1 is fastened along the guide 2, which sliding seat is movable back and forth in a linear manner along the guide 2 along the axis thereof. A footrest 8, on which the user can place his feet or against which he can press his feet or support said feet during a rowing stroke, is arranged in the region of the one end of the guide 2. In the case of the rowing movement, the user or rower sits on the sliding seat 1, supports his feet on the footrest 8 and holds the handles 7*a*, 7*b* with two hands. In the case of a rowing stroke, the handles 7*a*, 7*b* are then pulled from a position with stretched arms and bent knees in the direction of the chest and at the same time the legs of the user are stretched, as a result of which the sliding seat 1 slides back, that is to say away from the footrest 8 and the handles 7*a*, 7*b* are rotated or pivoted in the direction of the backward movement of the sliding seat 1. When the handles 7*a*, 7*b* are rotated or pivoted, the respective oarlock shaft 3*a*, 3*b* is also rotated, the two oarlock axes being rotated in different directions of rotation on account of the arrangement of the handles 7*a*, 7*b*, that is to say one clockwise and the other one counter-clockwise. Two outriggers 16*a*, 16*b*, which each extend to the side parallel to the standing surface of the frame 5 normal to the progression of the guide 2, are arranged on the frame 5. The oarlock shafts 3*a*, 3*b* are mounted in said outriggers 16*a*, 16*b*, as a result of which the oarlock shafts 3*a*, 3*b* are each arranged at a distance normal to the direction of movement of the guide and normal to the standing surface of the frame 5 on a side of the guide 2. The mechanism of a rowing boat, which usually also comprises outriggers on which the oars are rotatably arranged, is imitated as a result of the arrangement of the oarlock shafts 3*a*, 3*b* at a distance from the guide 2.

The oarlock shafts 3*a*, 3*b*, on the ends opposite the handles 7*a*, 7*b*, each comprise a lever 12*a*, 12*b* which is pivotable or rotatable with the handles 7*a*, 7*b* about the axis of the respective oarlock shaft 3*a*, 3*b*. Arranged on the end of each lever 12*a*, 12*b* is a pulling element, in the case of this embodiment a pull rod 13*a*, 13*b*, which transmits the force or power which is transmitted to the handles 7*a*, 7*b* by the rower to the drive mechanism 4. The drive mechanism 4 additionally comprises a braking device 6, to which the power or force, which the user outputs to the training apparatus 10 at the handles 7*a*, 7*b*, is discharged from the drive mechanism 4 and a resistance, torque or an effort is thus to be applied by the user in order to pivot the handles 7*a*, 7*b* about the axis of the oarlock shafts 3*a*, 3*b*. During the training by a rower, at every stroke, that is to say at every rotation of the handles 7*a*, 7*b*, the sliding seat 1 is slid back, that is to say away from the footrest 8, and the handles 7*a*, 7*b* are rotated in the direction of the sliding of the sliding seat 1. The force transmitted to the handles 7*a*, 7*b* is forwarded via the oarlock shafts 3*a*, 3*b* and the pulling element, or in the case of this embodiment the pull rods 13*a*, 13*b*, to the drive mechanism 4, said drive mechanism then outputting the power or force to the brake device 6. The drive mechanism 4 additionally comprises a freewheel 11 which is arranged between the oarlock shaft and the braking device 6. The freewheel 11 makes it possible to pivot the handles 7*a*, 7*b* independently of one another about the respective oarlock shaft 3*a*, 3*b*, the freewheel 11 allowing the force transmission or power transmission to the braking device 6 when the handles 7*a*, 7*b* are rotated in a first direction about the axis of the respective oarlock shaft 3*a*, 3*b*, that is to say in the direction of the backward movement of the sliding seat 1, and the freewheel 11 releasing the movement and thus being returnable without effort or without power being supplied to or removed from the braking device 6 when the handles 7*a*, 7*b* are actuated in a second direction, which is opposite to the first direction, about the axis of the respective oarlock shafts 3*a*, 3*b*, that is to say in the direction of the forward movement of the sliding seat 1.

Figure 2:
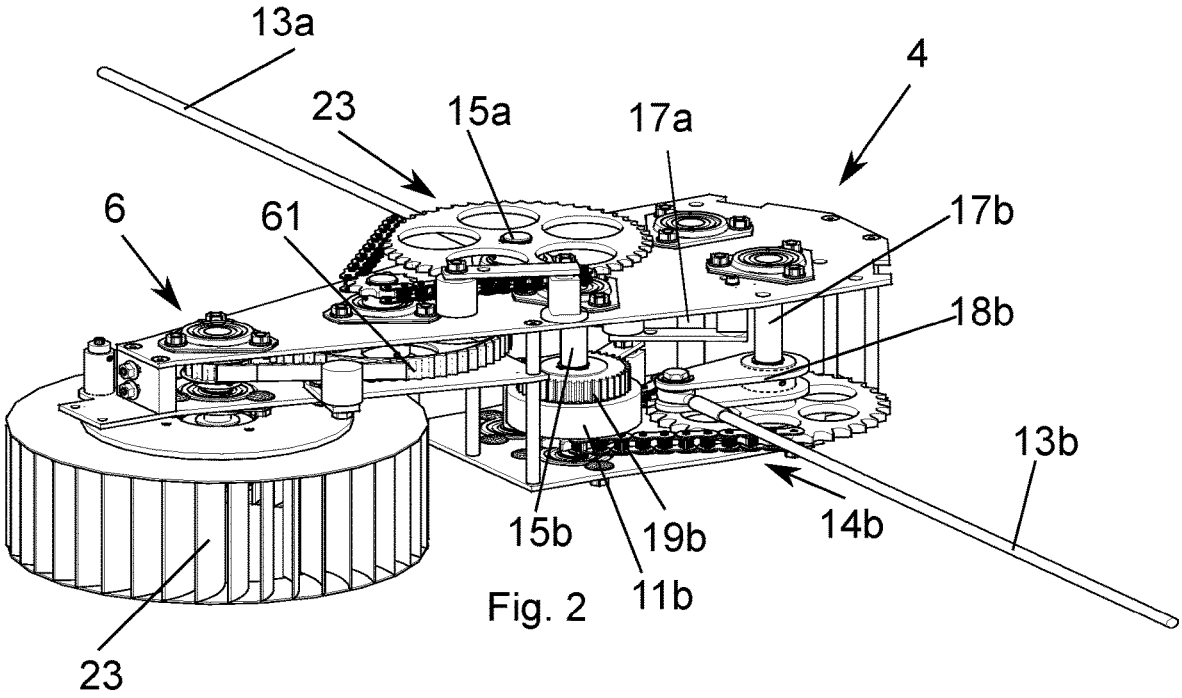
FIG. 2 shows an isometric view of a view of a detail of the drive mechanism.

FIG. 2 shows a view of a detail of a drive mechanism 4 of a preferred embodiment of the training apparatus 10. As explained with respect to FIG. 1, the force is forwarded to the drive mechanism 4 via the handles 7*a*, 7*b* by means of a pull rod 13*a*, 13*b* in each case. In the case of this embodiment, the drive mechanism 4 comprises a drawbar 18*a*, 18*b* for each pull rod 13*a*, 13*b*, which drawbars are connected at the end of the pull rods 13*a*, 13*b* opposite the levers 12*a*, 12*b* to the respective pull rod 17*a*, 17*b* and at the other end are each rotatably mounted on a shaft 17*a*, 17*b*. The drive mechanism 4 additionally includes a first chain drive 14*a* which is connected to the intermediate shaft 17*a* so that when the drawbar 18*b* is actuated or when the drawbar 18*b* is rotated, the chain drive 14*a* is rotated or pivoted by the pull rod 13*a*. A first intermediate shaft 15*a*, on which a first freewheel 11*a* is fastened, is arranged on the second end of the chain drive 14*a*. The second drawbar 18*b* is connected to a second chain drive 14*b* which transmits the rotational movement of the drawbar 18*b* to a second freewheel 11*b*. The second freewheel 11*b* comprises a second intermediate shaft 15*b* which is connected to the first intermediate shaft 15*a* by means of an intermediate pair of gear wheels consisting of two gear wheels 19*a*, 19*b*. If force or power is then output at the handles 7*a*, 7*b* via the oarlock shafts 3*a*, 3*b* and the pull rods 13*a*, 13*b* to the drive mechanism 4, as a result of the arrangement of the first chain drive 14*a* with the second chain drive 14*b* and the intermediate pair of gear wheels, the power from the second intermediate shaft 15*b* is transmitted to the first intermediate shaft 15*a* and consequently the power of the two handles 7*a*, 7*b* is added or totaled, that is to say the force, the torque and the power of the intermediate shaft 15*a* is increased by the force, the torque and the power of the second intermediate shaft 15*b*. If the handles 7*a*, 7*b* are then returned again in opposition to the backward movement of the sliding seat 1, the first freewheel 11*a* and the second freewheel 11*b* allow for a force-free or powerless resetting, as a result of which the rowing movement is repeated again in a force-free manner. A chain wheel of a further chain drive 27, by way of which the added or totaled power of the handles 7*a*, 7*b* or of the intermediate shaft 15*a* is output to a braking device or is transmitted to said braking device, is arranged once again on the first intermediate shaft 15*b*. The braking device 6 of FIG. 2 includes a belt drive 61 and a fan wheel 23 which is connected to the belt drive 61 so as to transmit force. The belt drive 61 is connected to the further chain drive 27, as a result of which the power or force from the further chain drive 27 or the first intermediate shaft 15*a* is transmitted to the fan wheel 23 and sets said fan wheel in rotation. As a result of the aerodynamic resistance of the fan wheel 23, a braking action or power is taken from the drive mechanism 4 and a training resistance is thus generated. As an option, the fan wheel 23 can also be arranged in a housing so that the aerodynamic resistance of the fan wheel 23 can be varied or adjusted in dependence on the design of the fan wheel 23 and of the housing. The housing can comprise, for example, a defined progression of the wall or guide vanes facing the fan wheel 23 in order to influence the aerodynamic characteristics of the fan wheel 23.

Figure 4:
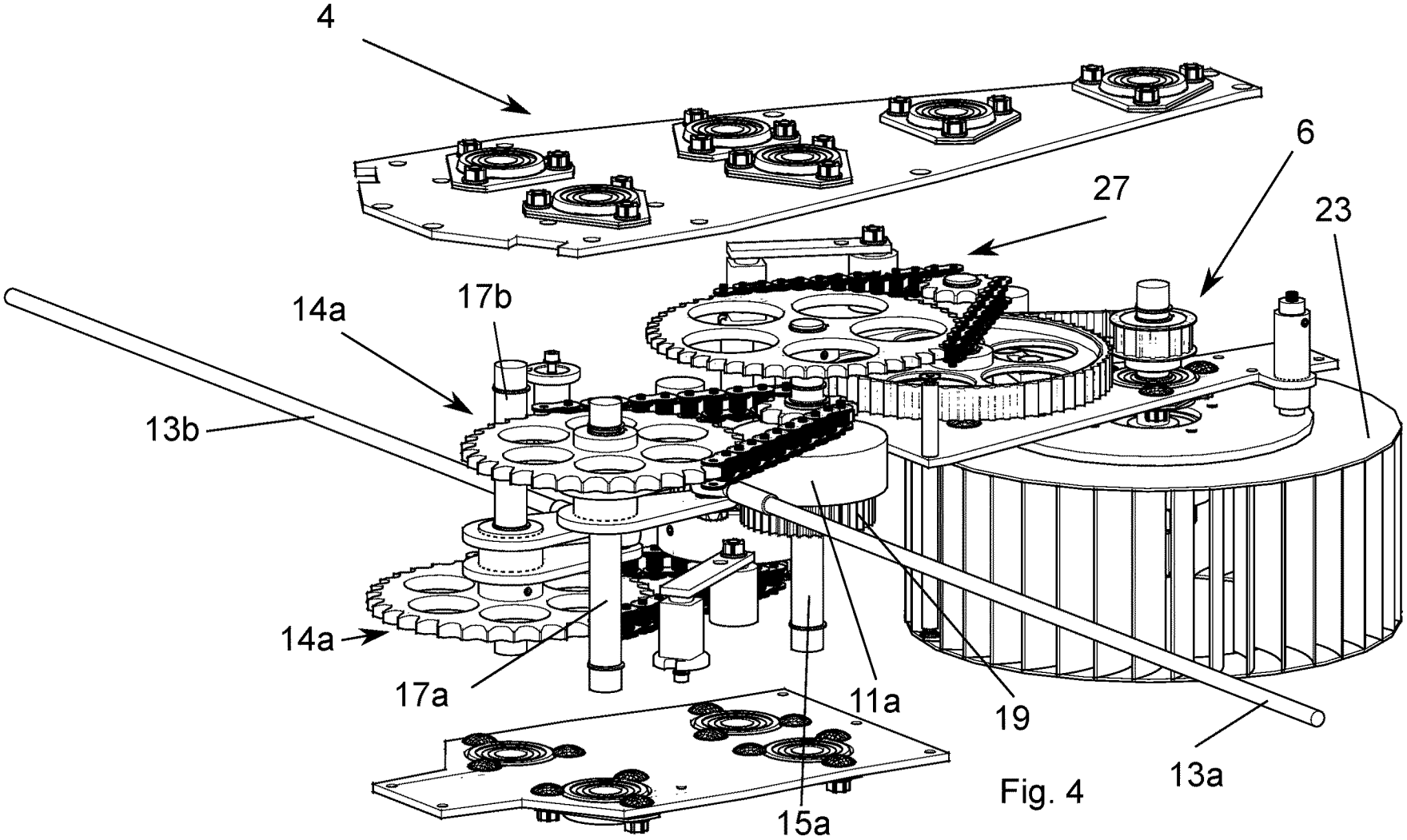
FIG. 4 shows an exploded view of an embodiment of the drive mechanism.

FIG. 4 shows an exploded view of the drive mechanism 4 according to FIG. 2 with a view of the first chain drive 14*a*. As a result of the arrangement of the first intermediate shaft 15*a* with the second intermediate shaft 15*b* and of the connection between the first intermediate shaft 15*a* and the second intermediate shaft 15*b* via a pair of intermediate gear wheels, the various directions of rotation of the first intermediate shaft 15*a* and of the second intermediate shaft 15*b* are converted into one common direction of rotation at the first intermediate shaft 15*a*. The power combined or added at the first intermediate shaft 15*a* is output to the braking device 6 of the training apparatus 10 via the further chain drive 27. Consequently, the power or force, which is transmitted to the oarlock shafts 3*a*, 3*b* by the user at the handles 7*a*, 7*b*, is transmitted via the respective pull rods 13*a*, 13*b* and the first chain drive 14*a* and the second chain drive 14*b* together via the first freewheel 11*a* and the second freewheel 11*b* to the first intermediate shaft 15*a* and consequently to the braking device 6. The first freewheel 11*a* and the second freewheel 11*b*, in this case, allow for the force-free or powerless resetting of the handles 7*a*, 7*b* when the handles 7*a*, 7*b* are returned in opposition to the backward movement of the sliding seat 1, whereby the rotational movement of the fan wheel 23 remains unchanged. Increased or reduced aerodynamic resistance of the fan wheel 23 or resistance uptake and power uptake of the braking device 6 is obtained in dependence on the stroke rate, that is to say in dependence on the amount and speed of the transmission of force to the handles 7*a*, 7*b*.

Figure 5:
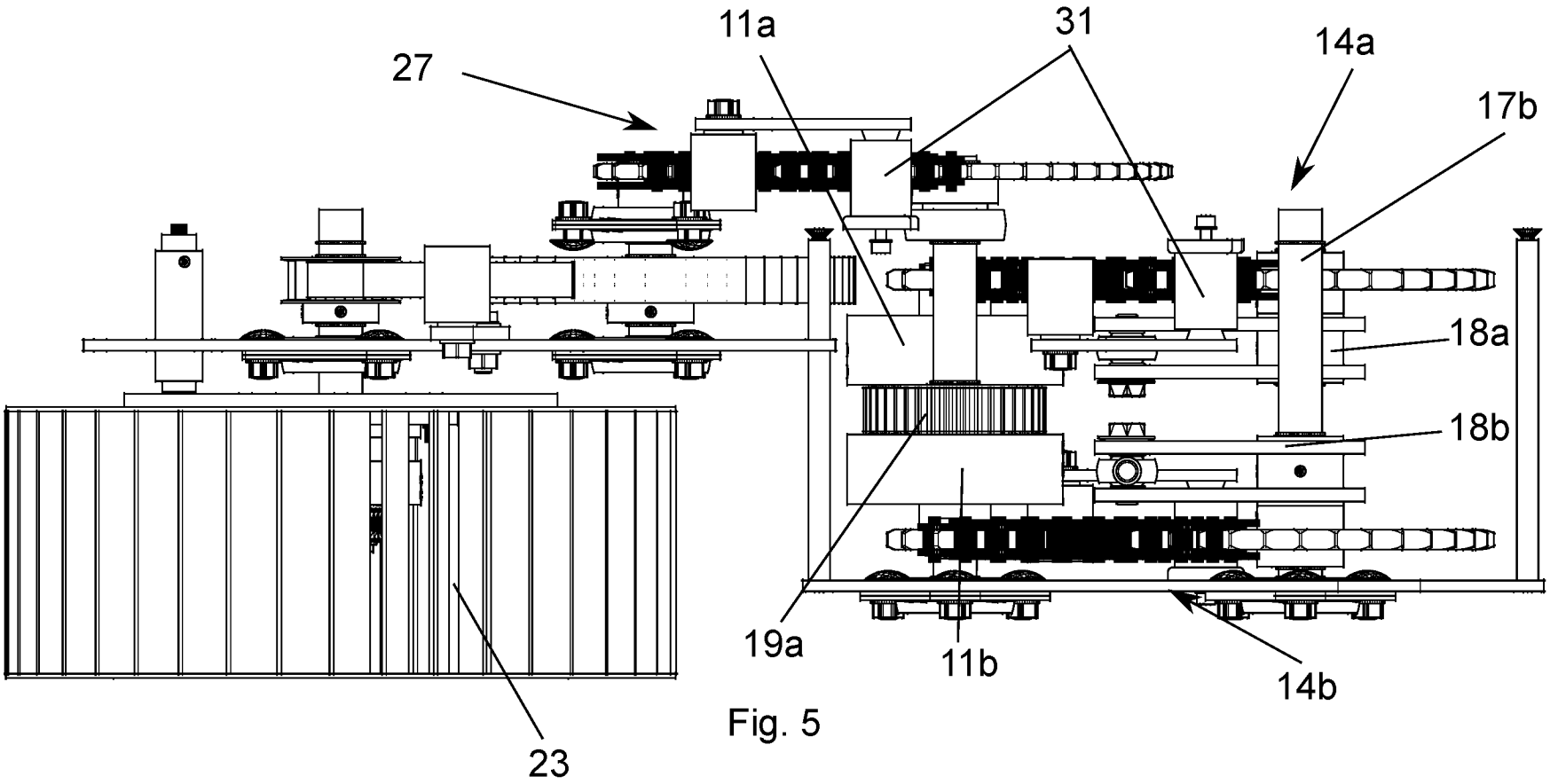
FIG. 5 shows a side view of the drive mechanism according to FIG. 4.

FIG. 5 shows a side view of a preferred embodiment of the training apparatus 10 with a view of the second chain drive 14*b* and the fan wheel 23. The first drawbar 18*a* is arranged at a distance above the second drawbar 18*b* in a plane parallel to the plane of the second drawbar 18*b* so that the pivoting movements of the drawbars 18*a*, 18*b* intersect one another in a projecting plane without the drawbars 18*a*, 18*b* touching one another. The drawbars 18*a*, 18*b*, and thereby the first chain drive 14*a*, 14*b*, are consequently arranged one above the other in two planes arranged in parallel at a spacing from one another and allow the drive mechanism 4 to be realized in a space-saving manner. The two drawbars 18*a*, 18*b* or the first chain drive 14*a* and the second chain drive 14*b* are arranged at a distance, that is to say offset, in the direction of the axes of the shafts 17*a*, 17*b* (FIG. 6), being arranged symmetrically at a distance about the axis of symmetry of the drive device 4 or the center axis of the guide 2.

Figure 6:
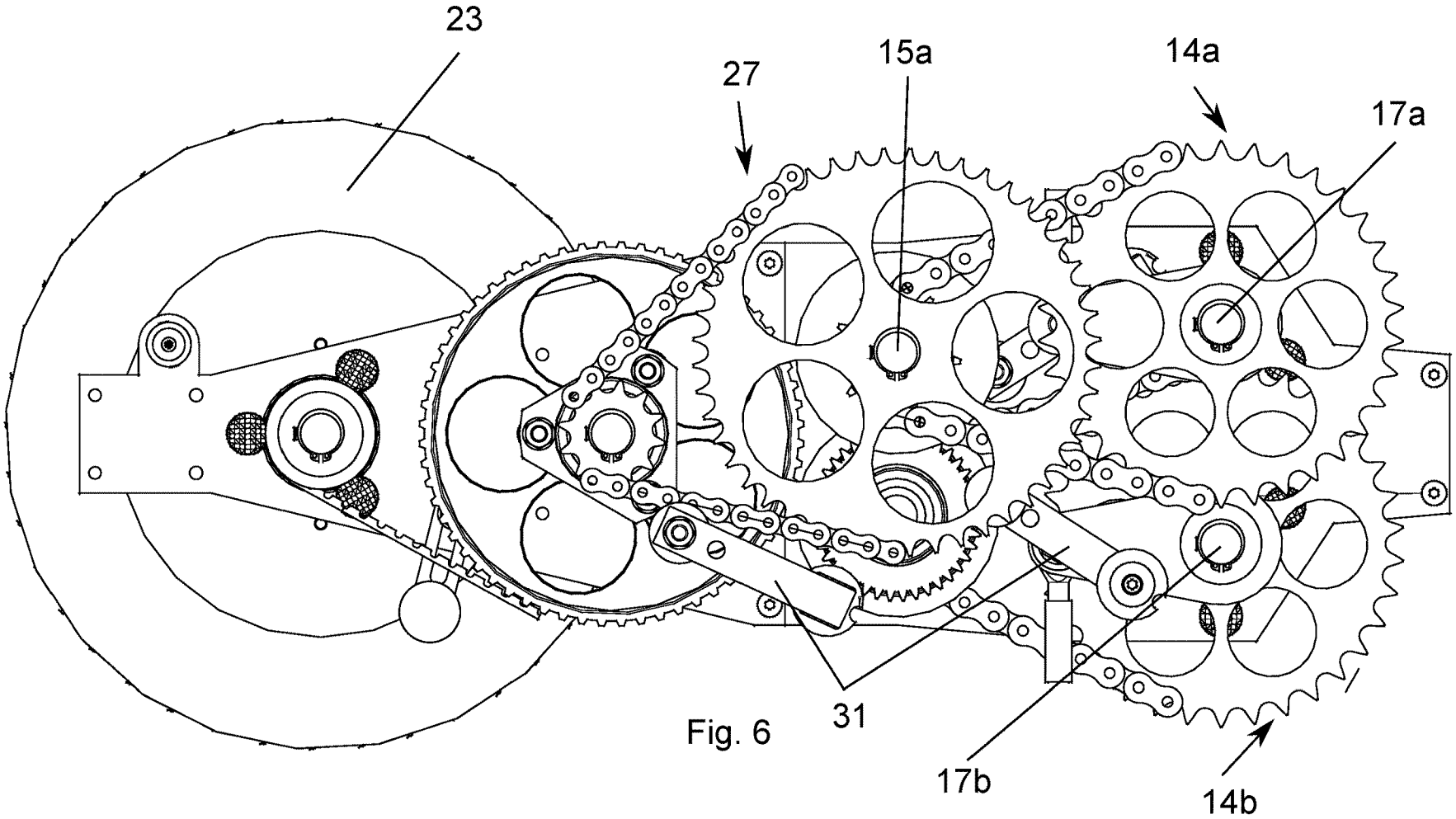
FIG. 6 shows a top view of the drive mechanism according to FIGS. 4 and 5.

As an option, also as shown in FIGS. 5 and 6, the drive mechanism 4 can comprise chain tensioners 31 for the first chain drive 14*a*, the second chain drive 14*b* and/or the further chain drive 27.

Figure 7:
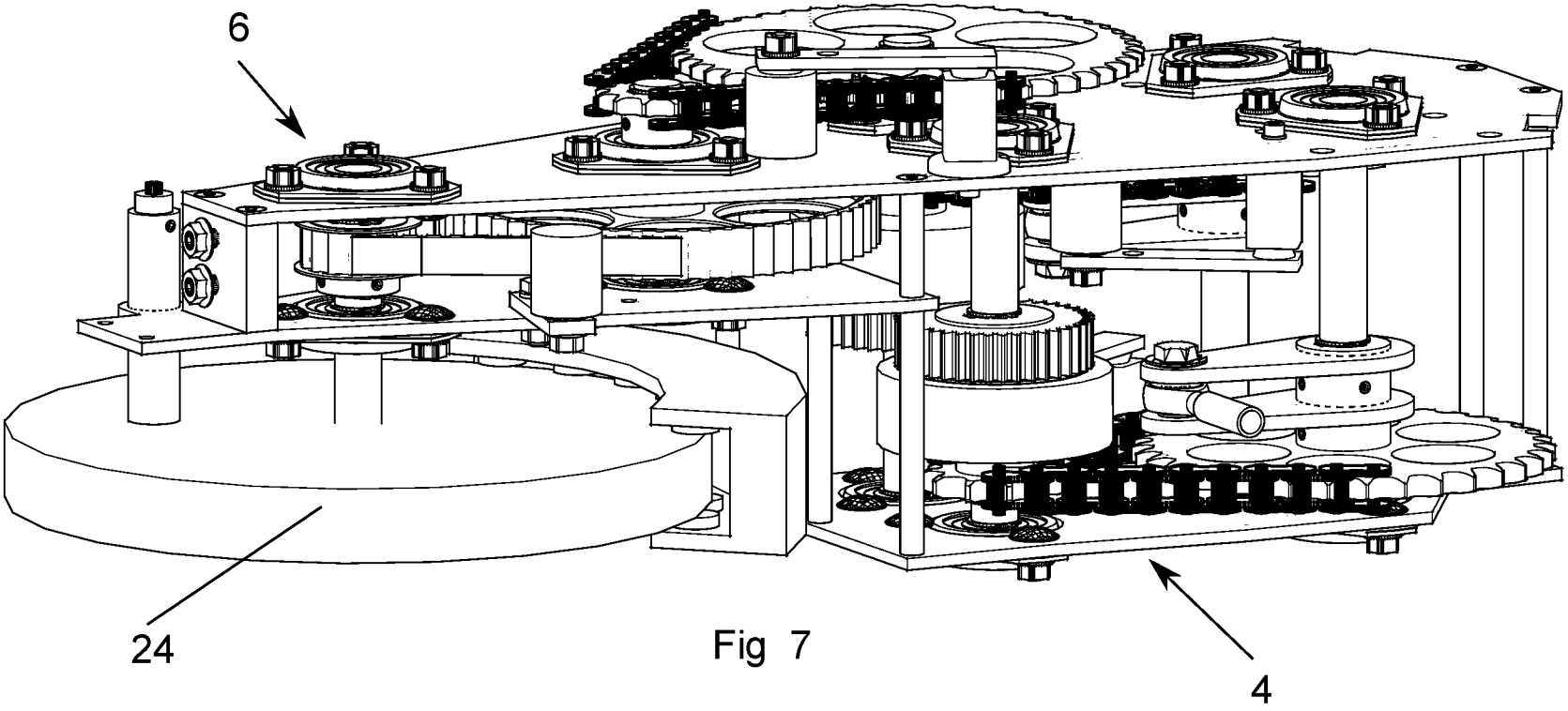
FIG. 7 shows an embodiment of the drive mechanism with a magnetic brake and FIG. 8 shows an embodiment of the drive mechanism with a current-generating element.

As an option, also as shown in FIG. 7, the braking device 6 can include a magnetic or eddy current brake 24 which enables a braking action or power take-up from the drive device 4. As a result of the realization of a magnetic or eddy current brake 24, it is possible to design the resistance inside the braking device 4 in a variable manner and to adjust it in dependence on the requirements of the user.

Figure 8:
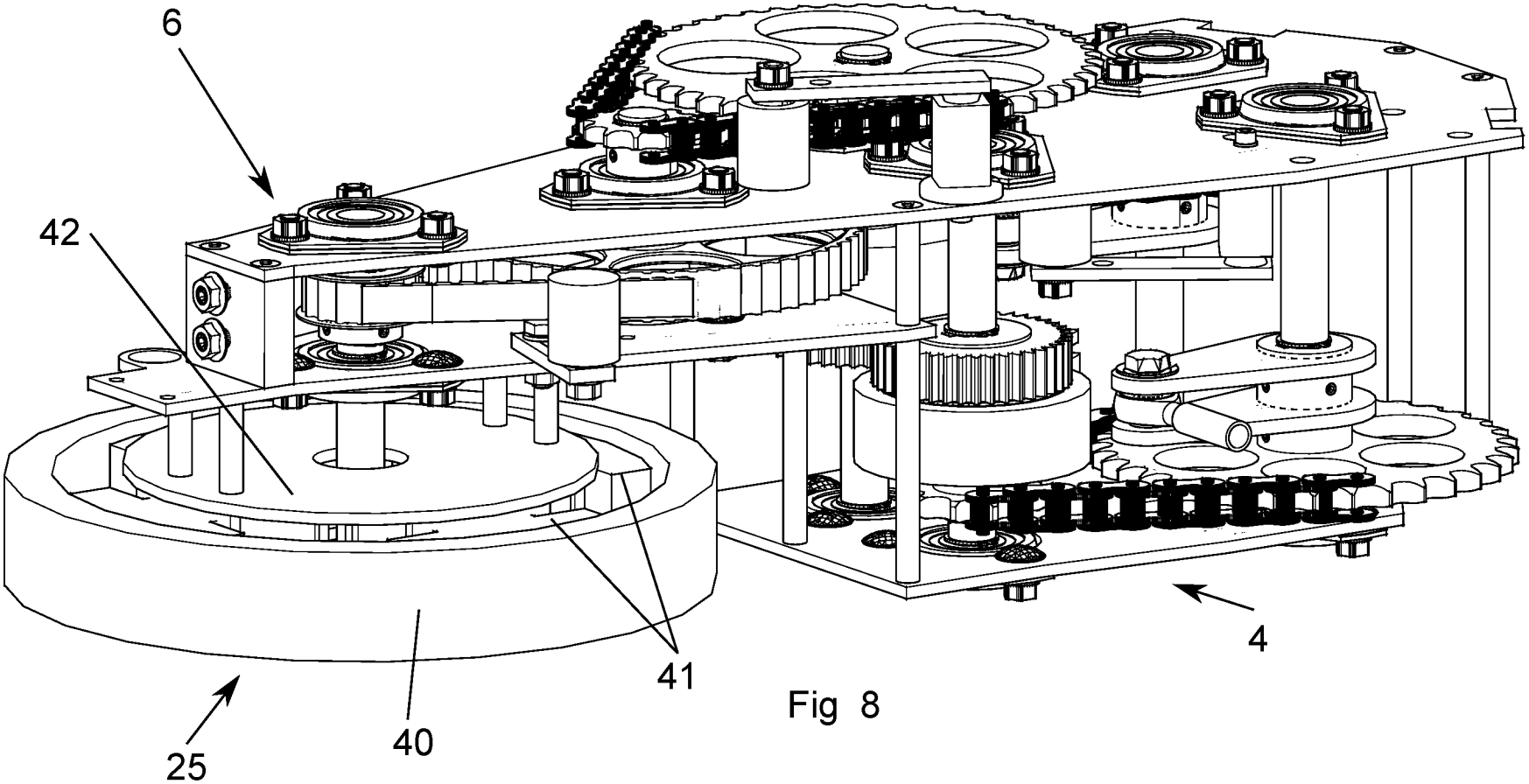

As an option, as shown in FIG. 8, the braking device 6 can also be realized as an element 25 which generates electric current. The element 25 generating current includes a copper disk 40 on which electric coils 41 are mounted. The copper disk 40 is covered by a metal disk 42 which is fixedly connected to a housing. As a result of rotating the copper disk 40, current is generated in the coils 41 and the resistance of the braking device 6 can be adjusted in a variable manner by a microcontroller by means of control unit in dependence on the coil setting. The amount of current fed to the coils 41 and the volume of the electromagnetic energy field generated as a result then determines the level of the resistance of the braking device 6 and consequently the amount of current generated by the rowing.

As an alternative to this, it can also be provided that the braking device 6 includes another element 25 which is disclosed in the prior art and generates electric current, such as, for example, a generator which converts the power of the rower or user supplied to the braking device 6 into electric current. The current generated can then be used for the operation of the training apparatus 10 and the resistance of the braking device 6 can be modified in dependence on the stroke rate, the force to the handles 7*a*, 7*b* and the position of the handles 7*a*, 7*b*.

As an option, it can be provided that the footrest 8 is fastened along the frame 5, for example by means of a tensioning mechanism, as a result of which the spacing between the footrest 8 and the guide 2 or the sliding seat 1 is able to be adapted to the user.

Figure 3:
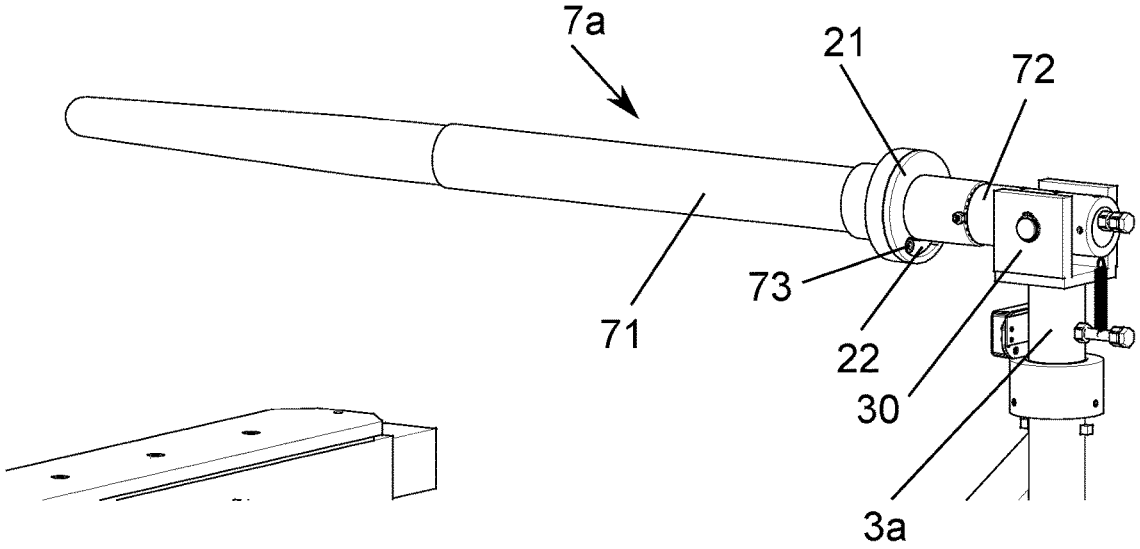
FIG. 3 shows a view of a detail of a handle and of part of an oarlock shaft.

FIG. 3 shows a preferred embodiment of one of the handles 7*a*, 7*b*. The handle 7*a* is realized in the form of an elongated cylinder. The handle 7*a* is realized in two parts, the first part 71 being realized in a hollow manner and being introduced into a second handle receiving means 72 which is realized in a mirror-inverted manner. The first part 71 of the handle 7*a* is rotatable in the handle receiving means 72 along the axis of the first part 71, as a result of which a rotational movement of the oar about its own axis in the water is able to be simulated. The handle 7*a* additionally comprises a stop 21 which is realized as an elongated hole 22 which extends along a radius. A continuation or a screw 73, which is connected to the first part 71 of the handle 7*a* which, when the first part 71 is rotated, slides along in the elongated hole 22 along the axis of said first part, extends in the elongated hole 22. The rotational movement along the axis of the first part 71 is delimited as a result of the dimensioning of the elongated hole 22 with the continuation or the screw 73.

As an alternative to this, the oarlock shafts 3*a*, 3*b*, such as shown, as an example, for a handle 7*a* in FIG. 3, can comprise, on one of their ends, an oarlock 30*a*, 30*b*, on which the handles 7*a*, 7*b* are mounted so as to be tiltable. The tilting or bearing arrangement of the handles 7*a*, 7*b* is effected, in this case, in an axis which is normal to the rotational axis of the oarlock shafts 3*a*, 3*b*, as a result of which the handles 7*a*, 7*b*, are able to be tilted or pivoted upward and downward with reference to the sliding seat 1 or to the user of the training apparatus 10.

As an option, it can be provided that the training apparatus 10 includes a force measuring device, said force measuring device preferably being integrated in the handles 7*a*, 7*b*. The force transmission of the force or power output at the handles 7*a*, 7*b* to the drive mechanism 4 can be measured using the force measuring device, the force measuring device being able to be realized preferably by a number of strain gauges which are arranged on the handles 7*a*, 7*b*. It can additionally be provided, as an option, that the angle of the rotation of the handles 7*a*, 7*b* about their axes is measurable, for example, by means of an angle transmitter and supplied to an electronic evaluation unit. As a result of the arrangement of the strain gauges on the handles 7*a*, 7*b*, it is possible to measure, in particular, the bending deformation of the handles 7*a*, 7*b* and thus to detect the force transmission to the handles 7*a*, 7*b* in each case separately from one another and, for example, to feed back or report different rowing movements of the individual arms to the user of the training apparatus 10.

It can additionally be provided, as an option, that the force which is detected by the force measuring device and is applied to the handles 7*a*, 7*b* by the user and/or the position of the handles about the respective oarlock shafts 3*a*, 3*b* and/or the position of the handles 7*a*, 7*b* about their axes, can be forwarded to the electronic evaluation unit. The resistance of the braking device 6 can be adapted to the measured parameters by means of the electronic evaluation unit. Thus, for example, the increased hydrodynamic resistance of the water when the speed of the boat or the stroke rate is raised can be adapted and a more realistic resistance in the braking device 6 is thus able to be simulated.

If force is exerted on the oar, the following is defined approximately:

$$F_{oar}=k2*(|v_{oar}|-v_{boat})^2 \quad (1)$$

wherein Foar is the force on the oars, voar the speed of the oar in the water and vboat the speed of a boat in the water. That is to say the necessary force on the oars rises quadratically with the difference in speed between oar or oar blade and rowing boat, the factor k2 taking into consideration the resistance of the oar. Thus, by means of the equation (1), the resistance at the braking device 6 can be adapted in each case to the force supplied by the user and the resistance of the oar in the water can be better simulated at higher boat speeds.

The boat speed changes under the influence of the force on the oars:

$$d(v\text{boat}(/dt=-k1*v\text{boat}\hat{}2+k3*F\text{oar} \quad (2)$$

wherein the value k1 takes into consideration the cw value of the boat in the water or the resistance of the air and of the water and the second term, k3*Foar, takes into consideration the acceleration of the boat on the basis of the rowing force.

As when returning the handles 7*a*, 7*b* into the starting position by means of the freewheel 11 or the freewheels 11*a*, 11*b*, no force is applied to the handles 7*a*, 7*b*, the speed of the boat is reduced or said speed is delayed as the second term of the equation (2) in said phase is zero. If the equations (1) and (2) are taken into consideration in the evaluation unit, the necessary force at the handles 7*a*, 7*b* or the power which the braking device takes away can be adapted thereto and a more realistic boat feeling can be simulated with the training apparatus 10.

As an alternative to the described chain drives 14*a*, 14*b*, 27, other force transmitting elements, for example belt drives or pairs of gear wheels or other gearings disclosed in the prior art, can also be provided.

Other braking devices 6 disclosed in the prior art can be provided optimally for the power take-up from the drive device 4, said other braking devices being able to include, for example, flywheels, mechanical brakes or others.

The invention claimed is:

1. A training apparatus for the simulation of rowing training, the training apparatus comprising:

a frame and a guide arranged on said frame;

a sliding seat linearly movable back and forth along said guide;

a footrest arranged in a vicinity of an end of said guide;

oarlock shafts disposed laterally of said guide;

two handles each rotatably mounted on a respective said oarlock shaft and rotatable independently of one another; and a drive mechanism connected to each of said oarlock shafts by way of a force-transmitting connection, said drive mechanism including a gearing and a braking device;

a lever pivotally mounted with said handles about the axis of the respective said oarlock shaft and disposed on each of said oarlock shafts, and a pulling element arranged on each said lever and configured to transmit a rotational movement of said handles to said drive mechanism, said pulling element being a pull rod;

said drive mechanism including at least one freewheel disposed between said oarlock shafts and said braking device such that said handles are pivotable independently of one another about a respective said oarlock shaft, and wherein, when said handles are actuated in a first direction about an axis of a respective said oarlock shaft, power is discharged to said braking device and when said handles are actuated in a second direction, which is opposite to the first direction, about the axis of the respective said oarlock shaft, said handles are returnable without power being fed to or discharged from said braking device.

2. The training apparatus according to claim 1, further comprising a force measuring device integrated in said handles and configured to measure a transmission of force to said drive mechanism by way of said handles and/or an angle of a rotation of said handles, said force measuring device including a plurality of strain gauges disposed to measure a bending deformation of said handles.

3. The training apparatus according to claim 2, wherein said force measuring device is configured to supply to an electronic evaluation unit information of a force applied to said handles and/or a position of said handles, and wherein a resistance of said braking device is adjustable in dependence on the force applied to said handles and/or on the position of said handles.

4. The training apparatus according to claim 3, wherein the position of said handles measured by said force measuring device is an angular position about the axes of rotation thereof.

5. The training apparatus according to claim 1, further comprising drawbars respectively arranged on each end of a respective said pulling element opposite said oarlock shaft and configured to transmit power from said handles to said drive mechanism.

6. The training apparatus according to claim 5, wherein said drawbars are arranged in such a manner in two spaced-apart, parallel planes so that pivoting movements of said drawbars intersect one another in a projecting plane without said drawbars touching one another.

7. The training apparatus according to claim 1, wherein said drive mechanism comprises at least one force-transmitting element arranged between one of said oarlock shafts and said braking device and configured to deflect different directions of rotation of said oarlock shafts into one common direction of rotation.

8. The training apparatus according to claim 7, wherein said force-transmitting element is a chain drive, a belt drive, or a pair of gear wheels.

9. The training apparatus according to claim 1, wherein:

said oarlock shafts include a first oarlock shaft and a second oarlock shaft, and said at least one freewheel includes a first freewheel and a second freewheel;

said drive mechanism comprises a first drive selected from the group consisting of a first chain drive, a first belt drive, and a first pair of gear wheels, for transmitting a rotational movement of said first oarlock shaft to said first freewheel;

the rotational movement of a second oarlock shaft is transmitted via a second drive selected from the group consisting of a second chain drive, a second belt drive, and a second pair of gear wheels to said second freewheel;

said first freewheel includes a first intermediate shaft and said second freewheel includes a second intermediate shaft, and wherein a rotational movement of said second intermediate shaft is transmitted to said first intermediate shaft by way of an intermediate chain drive or an intermediate pair of gear wheels or an intermediate belt drive so that the power or force which is transmitted to said handles can be added to said first intermediate shaft, and wherein an added power is deliverable from said first intermediate shaft to said braking device.

10. The training apparatus according to claim 9, wherein the added power is deliverable to said braking device via a further chain drive or a further belt drive or a further pair of gear wheels.

11. The training apparatus according to claim 1, wherein said handles are pivotally mounted in an axis normal to an axis of said oarlock shaft.

12. The training apparatus according to claim 11, wherein said handles are pivotally mounted at an end of the respective said oarlock shaft.

13. The training apparatus according to claim 1, wherein said oarlock shafts are each arranged perpendicular to a direction of movement of said guide and/or to a standing surface of said frame, at a distance from said guide.

14. The training apparatus according to claim 1, wherein said handles are elongated cylinders rotatably mounted about axes of said cylinders and said handles include a stop configured to delimit a rotation in the cylinder axes of said handles.

15. The training apparatus according to claim 1, wherein said braking device comprises a device selected from the group consisting of a fan wheel, a magnetic brake, an eddy current brake, and an element which generates an electric current.

16. The training apparatus according to claim 1, further comprising two outriggers mounted to said frame, and wherein each of said oarlock shafts is mounted in a respective one of said outriggers.

17. The training apparatus according to claim 1, wherein each of said oarlock shafts includes oarlock having one of said handles mounted thereon.

18. A training apparatus for the simulation of rowing training, the training apparatus comprising:

a frame and a guide arranged on said frame;

a sliding seat linearly movable back and forth along said guide;

a footrest arranged in a vicinity of an end of said guide;

oarlock shafts disposed laterally of said guide, said oarlock shafts include a first oarlock shaft and a second oarlock shaft;

two handles each rotatably mounted on a respective said oarlock shaft and rotatable independently of one another; and a drive mechanism connected to each of said oarlock shafts by way of a force-transmitting connection, said drive mechanism including a gearing and a braking device;

said drive mechanism including at least one freewheel disposed between said oarlock shafts and said braking device such that said handles are pivotable independently of one another about a respective said oarlock shaft, and wherein, when said handles are actuated in a first direction about an axis of a respective said oarlock shaft, power is discharged to said braking device and when said handles are actuated in a second direction, which is opposite to the first direction, about the axis of the respective said oarlock shaft, said handles are returnable without power being fed to or discharged from said braking device;

said at least one freewheel includes a first freewheel and a second freewheel; said drive mechanism comprises a first drive selected from the group consisting of a first chain drive, a first belt drive, and a first pair of gear wheels, for transmitting a rotational movement of said first oarlock shaft to said first freewheel;

the rotational movement of a second oarlock shaft is transmitted via a second drive selected from the group consisting of a second chain drive, a second belt drive, and a second pair of gear wheels to said second freewheel;

said first freewheel includes a first intermediate shaft and said second freewheel includes a second intermediate shaft, and wherein a rotational movement of said second intermediate shaft is transmitted to said first intermediate shaft by way of an intermediate chain drive or an intermediate pair of gear wheels or an intermediate belt drive so that the power or force which is transmitted to said handles can be added to said first intermediate shaft, and wherein an added power is deliverable from said first intermediate shaft to said braking device.

* * * * *